US008155323B2

(12) United States Patent
Chabanne

(10) Patent No.: US 8,155,323 B2
(45) Date of Patent: Apr. 10, 2012

(54) METHOD FOR IMPROVING SPATIAL PERCEPTION IN VIRTUAL SURROUND

(75) Inventor: Christophe Chabanne, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 122 days.

(21) Appl. No.: 10/498,336

(22) PCT Filed: Dec. 6, 2002

(86) PCT No.: PCT/US02/38915

§ 371 (c)(1),
(2), (4) Date: Jun. 10, 2004

(87) PCT Pub. No.: WO03/053099

PCT Pub. Date: Jun. 26, 2003

(65) Prior Publication Data

US 2005/0129249 A1 Jun. 16, 2005

Related U.S. Application Data

(60) Provisional application No. 60/344,315, filed on Dec. 18, 2001.

(51) Int. Cl.
*H04R 5/00* (2006.01)

(52) U.S. Cl. ..... 381/17

(58) Field of Classification Search ..... 381/17–23, 381/309–310, 63, 61, 1, 307, 74; 700/94
See application file for complete search history.

(56) References Cited

U.S. PATENT DOCUMENTS 3,236,949 A 2/1966 Atal et al.
4,159,397 A * 6/1979 Iwahara et al. ..... 381/19
4,817,149 A * 3/1989 Myers ..... 381/1
5,371,799 A * 12/1994 Lowe et al. ..... 381/310
5,590,204 A 12/1996 Lee
5,742,689 A 4/1998 Tucker et al.
5,809,149 A 9/1998 Cashion et al.

(Continued)

FOREIGN PATENT DOCUMENTS

JP 7222297 8/1995

(Continued)

OTHER PUBLICATIONS

Blauert, Jens,"Spatial Hearing," (revised edition, 1983, M.I.T.), section 2.4.1. (Interaural time differences), pp. 140-155, section 2.4.2. (Interaural level differences), pp. 155-164, section 2.4.3. ("The interaction of interaural time and level differences"), pp. 164-177 and pp. 276-277.

(Continued)

*Primary Examiner* — Davetta W Goins
*Assistant Examiner* — Lun-See Lao

(57) ABSTRACT

A method for improving the spatial perception of multiple sound channels when reproduced by two loudspeakers, generally front-located with respect to listeners, each channel representing a direction, applies some of the channels, such as sound channels representing directions other than front directions, to the loudspeakers with headphone and crosstalk cancelling processing, and applies the other ones of the sound channels, such as sound channels representing front directions to the loudspeakers without headphone and crosstalk cancelling processing. The headphone processing includes applying directional HRTFs to channels applied to the loudspeakers with headphone and crosstalk cancelling processing and may also include adding simulated reflections and/or artificial ambience to channels applied to the loudspeakers with headphone and crosstalk cancelling processing.

12 Claims, 2 Drawing Sheets

U.S. PATENT DOCUMENTS

| | | | | |
|---|---|---|---|---|
| 5,862,227 | A * | 1/1999 | Orduna-Bustamante et al. | 381/17 |
| 6,021,206 | A | 2/2000 | McGrath | |
| 6,026,169 | A * | 2/2000 | Fujimori | 381/61 |
| 6,144,747 | A | 11/2000 | Saunders et al. | |
| 6,154,545 | A | 11/2000 | Embree et al. | |
| 6,195,434 | B1 * | 2/2001 | Cashion et al. | 381/17 |
| 6,259,795 | B1 | 7/2001 | McGrath | |
| 6,307,941 | B1 | 10/2001 | Lester, III et al. | |
| 6,449,368 | B1 * | 9/2002 | Davis et al. | 381/1 |
| 6,574,649 | B2 | 6/2003 | McGrath | |
| 2001/0014159 | A1 * | 8/2001 | Masuda | 381/22 |

FOREIGN PATENT DOCUMENTS

| | | | |
|---|---|---|---|
| JP | 8265899 | | 10/1996 |
| WO | 99-14983 | A1 | 3/1999 |
| WO | WO 99/14983 | | 3/1999 |
| WO | WO 9914983 | | 3/1999 |
| WO | WO 99/33325 | | 7/1999 |
| WO | WO 03/053099 | A1 | 6/2003 |

OTHER PUBLICATIONS

Begault, Durand R., "3-D Sound or Virtual Reality and Multimedia," Apr. 2000, NASA, Ames Research Center, California (published as a public document on the internet at http://human-factors.arc.nasa.gov./ihh/spatial/papers/pdfs_db/Begault_2000_3d_Sound_Multimediapdf) See in particular "Interaural Time and Intensity Cues" (pp. 31-36), "Implementation of Lateralized Positions" (pp. 104-105) (note especially FIGS.4.7, 4.8 and 4.11), description of IIR filter for the simulation of reverberation (pp. 108 and 109, FIGS. 4.15 and 4.16), "Synthetic Reverberation" (pp. 141-145), and Overview of Auralization (pp. 145-146).

Japanese Patent Office—Aug. 7, 2007—Office Action for Application No. 2003-553870.

Toole, Floyd D., "The Future of Stereo," Audio, Jun. 1997, pp. 34-39.

Toole, Floyd E., "Binaural Record/Reproduction Systems and Their use in Psychoacoustic Investigations," AES 9st Convention 1991, Oct. 4-8, New York.

U.S. Appl. No. 10/970,123, filed Oct. 21, 2004, Reilly.

CN First Office Action dated Aug. 3, 2007, CN Application No. 02825105.9. Dolby Laboratories Licensing Corporation.

Response to CN First Office Action dated Aug. 3, 2007, CN Application No. 02825105.9, filed Feb. 3, 2008. Dolby Laboratories Licensing Corporation.

CN Second Office Action dated Jul. 11, 2008, CN Application No. 02825105.9. Dolby Laboratories Licensing Corporation.

Response to CN Second Office Action dated Jul. 11, 2008, CN Application No. 02825105.9, filed Nov. 10, 2008. Dolby Laboratories Licensing Corporation.

Notice of First Examination Report dated Jul. 13, 2007, India Patent Application No. 629/KOLNP/2004, Dolby Laboratories Licensing Corporation.

Response to First Examination Report dated Jul. 13, 2007, India Patent Application No. 629/KOLNP/2004, filed Jun. 16, 2008. Dolby Laboratories Licensing Corporation.

Notice of Reason for Rejection (Official Action) dated Aug. 7, 2007, JP Patent Application No. 2003-553870. Dolby Laboratories Licensing Corporation.

Response to Reason for Rejection (Official Action) dated Aug. 7, 2007, JP Patent Application No. 2003-553870, filed Feb. 7, 2008. Dolby Laboratories Licensing Corporation.

First Office Action, Mexican Patent Office, Mexican Patent Application No. PA/a/2004/005895. Dolby Laboratories Licensing Corporation.

Response to First Office Action, Mexican Patent Office, Mexican Patent Application No. PA/a/2004/005895. Dolby Laboratories Licensing Corporation.

Second Office Action, Mexican Patent Office, Mexican Patent Application No. PA/a/2004/005895. Dolby Laboratories Licensing Corporation.

Response to Second Office Action, Mexican Patent Office, Mexican Patent Application No. PA/a/2004/005895. Dolby Laboratories Licensing Corporation.

International Search Report and written opinion for International Application No. PCT/AU2004/001479.

Notice of Abandonment, dated May 2, 2006, U.S. Appl. No. 09/604,182.

Advisory Action Before the Filing of an Appeal Brief, dated Nov. 16, 2005, U.S. Appl. No. 09/604,182.

Response to Office Action (after Final), dated Oct. 24, 2005, U.S. Appl. No. 09/604,182.

Office Action dated Oct. 21, 2005, U.S. Appl. No. 09/604,182.

Response to Office Action Under 37 CFR 1.111 and Claim to Foreign Priority, dated Feb. 28, 2005, U.S. Appl. No. 09/604,182.

Office Action dated Oct. 28, 2004, with cited references, U.S. Appl. No. 09/604,182.

Response to Office Action after Final Under 37 CFR 1.116, dated Sep. 17, 2004, Office Action dated Oct. 21, 2005, U.S. Appl. No. 09/604,182.

Office Action dated Jul. 9, 2004, Office Action dated Oct. 21, 2005, U.S. Appl. No. 09/604,182.

Response to Office Action Under 37 CFR 1.111 , dated Apr. 15, 2004, Office Action dated Oct. 21, 2005, U.S. Appl. No. 09/604,182.

First Office Action dated Jan. 20, 2004, Office Action dated Oct. 21, 2005, U.S. Appl. No. 09/604,182.

EP Communication pursuant to Article 94(3) EPC mailed Apr. 13, 2010 in EP Application No. 02 784 742.5.

EP Communication pursuant to Article 94(3) EPC mailed Dec. 11, 2008 in EP Application No. 02 784 742.5.

* cited by examiner

METHOD FOR IMPROVING SPATIAL PERCEPTION IN VIRTUAL SURROUND

TECHNICAL FIELD

The invention relates to audio signal processing. More particularly, the invention relates to improving the spatial perception of a multichannel sound source when reproduced by two loudspeakers.

BACKGROUND ART

Multichannel sound reproduction systems such as Dolby Pro Logic or Dolby Digital (Dolby, Dolby Pro Logic and Dolby Digital are trademarks of Dolby Laboratories Licensing Corporation) require, for example, five speakers, placed at particular locations and particular angles. This can be costly and space consuming. It would be desirable to have surround sound without rear loudspeakers, to save on cost and space. However, conventionally, front loudspeakers only provide front sound images.

It is known to process multiple channels representing sounds from many directions, and combine them into two signals for reproduction over headphones, retaining the apparent multiple directions. With headphone reproduction the left signal goes to the left ear, and the right to the right, with no crosstalk. Sounds can appear to come from the sides of the listener as well as from the front, or in some cases the rear.

Considering each of the multichannel inputs as representing sound from a particular direction, such processing for headphones typically includes at least applying appropriate HRTFs (head related transfer functions) to each input to simulate the paths from its desired apparent direction to the two ears, so that the headphone listener perceives each channel as coming from the desired direction. Such headphone processors, which provide two outputs in response to more than two inputs, are referred to by a variety of names such as "multi-axis binaural steering" processors, "multi-channel binaural synthesizers", "headphone virtual surround" processors, and the like. Some headphone processors also provide processing in addition to applying directional HRTFs, such as adding simulated reflections and/or artificial ambience to one or more of the channels. All such processors, whether employing only directional HRTFs or also additional processing, such as artificial reflections and/or ambience, are referred to herein as "headphone processors." Some examples of headphone processors include those described in published International Application WO 99/14983 (designating the United States) and in U.S. Pat. Nos. 5,371,799; 5,809,149; and 6,195,434 B1. Each of said application and patents are hereby incorporated by reference, each in their entirety.

Conventional two-channel stereophonic material is intended for reproduction over two loudspeakers. Each of the listener's ears receives sound from both loudspeakers, with, of course, different path lengths and frequency responses. In other words, there is acoustic crosstalk. In general, all sounds so reproduced appear to lie within the space between the loudspeakers.

It is also known to modify signals prior to application to two loudspeakers to cancel the acoustic crosstalk, at least partially. This allows the apparent position of sounds to lie well outside the space between the loudspeakers, and is the basis of "virtual surround" processes. To the extent that the crosstalk is cancelled, the sounds entering the ears from the two loudspeakers resemble those provided by headphones, i.e., without crosstalk. Crosstalk cancellers (sometimes referred to as "spatializers" or "panoramic processors") are well known in the art, dating at least from U.S. Pat. No. 3,236,949 (Atal and Schroeder), which patent is hereby incorporated by reference in its entirety. A computer-software-implemented acoustic-crossfeed canceller using very low processing resources of a personal computer is disclosed in U.S. patent application Ser. No. 08/819,582 of Davis et al, filed Mar. 14, 1997, which application is hereby incorporated by reference in its entirety.

As is also known, signals representing multiple channels, including sounds originally coming from outside the space between the loudspeakers can be processed as if for reproduction over headphones and then fed via an acoustic crosstalk canceller to two front loudspeakers arranged in a conventional stereo configuration, such as at the sides of a computer monitor or a television picture tube. This combination of headphone processing and crosstalk cancellation allows the apparent position of sound sources to lie to the sides, or in some cases the rear, using only a pair of front loudspeakers.

FIG. 1 is a schematic block diagram showing a prior art arrangement in which the multiple channels of a multichannel source, such as a five-channel source (each channel representing a direction, such as left front, center front, right front, left surround and right surround), are applied to a headphone processor 2. The two outputs of the headphone processor are applied to a crosstalk canceller 4, which also has two outputs. One output of the crosstalk canceller is applied to a first loudspeaker 6 and the other output is applied to a second loudspeaker 8.

The combination of headphone processing and crosstalk cancellation feeding a pair of loudspeakers is superior to a crosstalk canceller alone because the processing for headphone reproduction introduces additional directional cues by introducing directional HRTFs (crosstalk cancellers may include only "one ear to the other" HRTFs) and, in some headphone processors, simulated multiple acoustic paths (including reflections) between apparent image positions (outside the loudspeakers) and the listener's ears. Thus, with combined headphone processing and crosstalk cancellation, virtual sound images may appear not only at the sides of a listener's head but also from further back.

However, there are disadvantages of such a combined headphone processing and crosstalk cancellation scheme. The front sound channels deft front, center front, right front) of the multichannel source are intended to be reproduced over loudspeakers and are satisfactorily reproduced by two loudspeakers that reproduce the left front and right front channels and also provide a virtual or "phantom" center front image (provided, of course, that the listener is appropriately located with respect to the two loudspeakers). Consequently, processing the front sound channels is not necessary and should be avoided (in accordance with the "least treatment" principle). Headphone processing of the front channels involves at least the application of directional HRTFs that may cause colorations or changes in timbre, for example. Other headphone processing techniques, for example the simulation of reflections or reverberation, may introduce other noticeable and unnecessary alterations of the front channel signals or may produce artifacts. Crosstalk cancellation may also adversely affect the front channels. Crosstalk cancellation is most effective when the playback environment, the listening room, introduces little by way of reflections. Consequently, in practical "real listening room" applications, crosstalk cancellation is incomplete. Thus, even if headphone processing of the front channels were transparent, the subsequent crosstalk cancellation in prior art of the type shown in FIG. 1 would likely impair the reproduced front channel sound.

In accordance with the present invention, impairment of the front channel reproduction is avoided while retaining the benefits of improved surround channel reproduction from a pair of loudspeakers.

DISCLOSURE OF THE INVENTION DETAILED DESCRIPTION OF THE PREFERRED EMBODIMENTS

Figure 1:
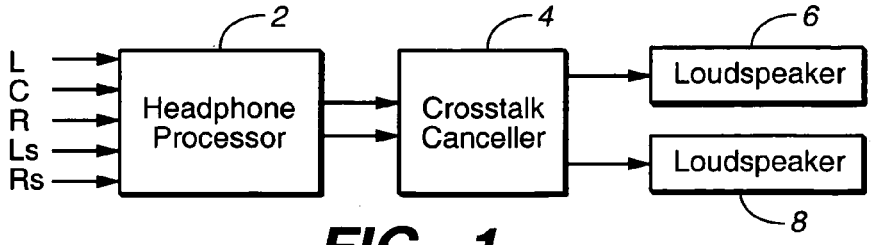
FIG. 1 (PRIOR ART)
FIG. 1 is a schematic block diagram showing a prior art arrangement in which the multiple channels of a multichannel source, such as a five-channel source (each channel representing a direction, such as left front, center front, right front, left surround and right surround), are applied to a pair of front-located loudspeakers via a headphone processor and a crosstalk canceller.
Figure 2:
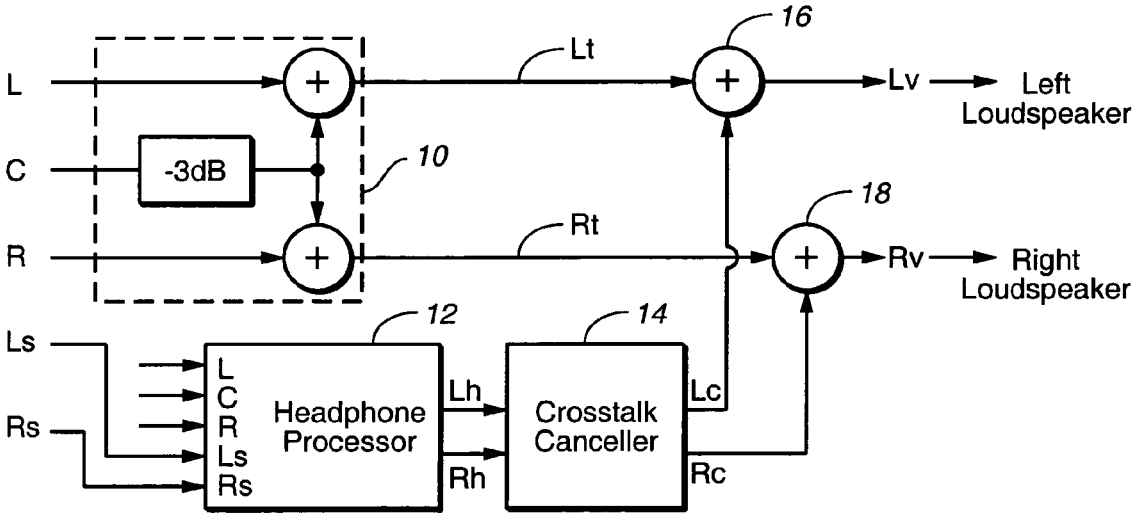
FIG. 2 is an idealized functional block diagram of an arrangement in accordance with the present invention.

FIG. 2 shows an idealized functional block diagram of an arrangement in accordance with the present invention that receives the multiple channels of a multichannel source, such as a five-channel source (each channel representing a direction, such as left front (L), center front (C), right front (R), left surround (Ls) and right surround (Ls)), applies the secondary channels (such as left surround and right surround) via a headphone processor and a crosstalk canceller to a pair of front-located loudspeakers and applies the main channels (such as left, center, right) to the pair of front-located loudspeakers without headphone or crosstalk cancelling processing.

The source of the multidirectional sound sources applied to the arrangement of FIG. 2 is not critical and may be any suitable source, including, for example, a Dolby Pro Logic source, a Dolby Digital source, a Digital Theater Systems Corporation ("DTS") source ("DTS" is a trademark), a discrete source, or some other source. Although the invention will be described in connection with an embodiment that has three main channels and two secondary channels, the invention is not so limited. For example, there may be only two main channels, such as left and right, and/or there may be more than two secondary channels, such as five secondary channels (for example, left front surround (LFS), left rear surround (LRS), right front surround (RFS), right rear surround (RRS) and center surround (CS)). The number of secondary channels is limited only by the complexity of the headphone processor and its ability to simulate the placement of sounds in a large number of directions.

As shown in FIG. 2, a portion of the arrangement is a conventional prior art Dolby MP Matrix encoder configured as a 3:2 encoder. The matrix encoder 10 accepts three separate input signals; left front, center front, and right front (L, C, R), and creates two final outputs, left total and right total (Lt and Rt). The C input is divided equally and summed with the L and R inputs with a 3 dB level reduction in order to maintain constant acoustic power.

The left-total (Lt) and right-total (Rt) encoded signals may be expressed as $$Lt=L+0.707C; \text{ and}$$

$$Rt=R+0.707C,$$

where L is the left front input signal, R is the right front input signal, and C is the center front input signal. When the Lt encoded signal is reproduced by a left-located front loudspeaker and the Lt encoded signal is reproduced by a right-located front loudspeaker, a virtual or "phantom" center channel image may be perceived by a properly located listener. The use of a center channel is not critical and may be omitted, in which case the L and R input signals may be coupled directly to the loudspeakers without any requirement for a matrix to mix in the center channel. If an encoder matrix is employed, it need not mix in the center channel at −3 dB but may employ some other mixing level. In any case, in accordance with the present invention, the main channels intended for reproduction by two front-positioned loudspeakers (such as the left front, center front (if employed) and right front channels) are not applied to the two loudspeakers via a headphone processor and/or a crosstalk canceller.

Still referring to FIG. 2, the left surround (Ls) and right surround (Rs) supplemental channel signals are applied to the left surround (Ls) and right surround (Rs) inputs of a headphone processor 12. Headphone processor 12 has characteristics such as described above. Such headphone processors may also have inputs for left front (L), center front (C) and right front (R) signals, as shown in FIG. 2; however, those inputs are not used. As explained above, there may be additional supplemental channel signals applied to headphone processor 12 provided that the device is capable of processing more than two secondary channel inputs. Headphone processor 12 provides two output signals, left headphone (Lh) and right headphone (Rh). These outputs are intended to provide a headphone listener with the perception that each of the secondary channel inputs is coming from the desired direction. The Lh and Rh output signals are not applied to headphones but to a crosstalk canceller 14 that, in turn, provides crosstalk cancelled versions of the Lh and Rh signals, designated here as left canceller (Lc) and right canceller (Rc). The Lc signal is additively combined with the Lt signal in a summer 16 to produce a left virtual (Lv) and the Rc signal is additively combined with the Rt signal in a summer 18 to produce a right virtual (Rv) signal. The Lv signal may then be coupled to a suitable left-positioned front-located loudspeaker (not shown) and the Rv signal may then be coupled to a suitable right-positioned front-located loudspeaker (not shown). Reproduction of the Lv and Rv signals by such loudspeakers provides a properly located listener with the perception of main channel sounds without the shortcomings of headphone processor and/or crosstalk canceller processing while providing enhanced phantom images of the secondary channel sounds.

Figure 3:
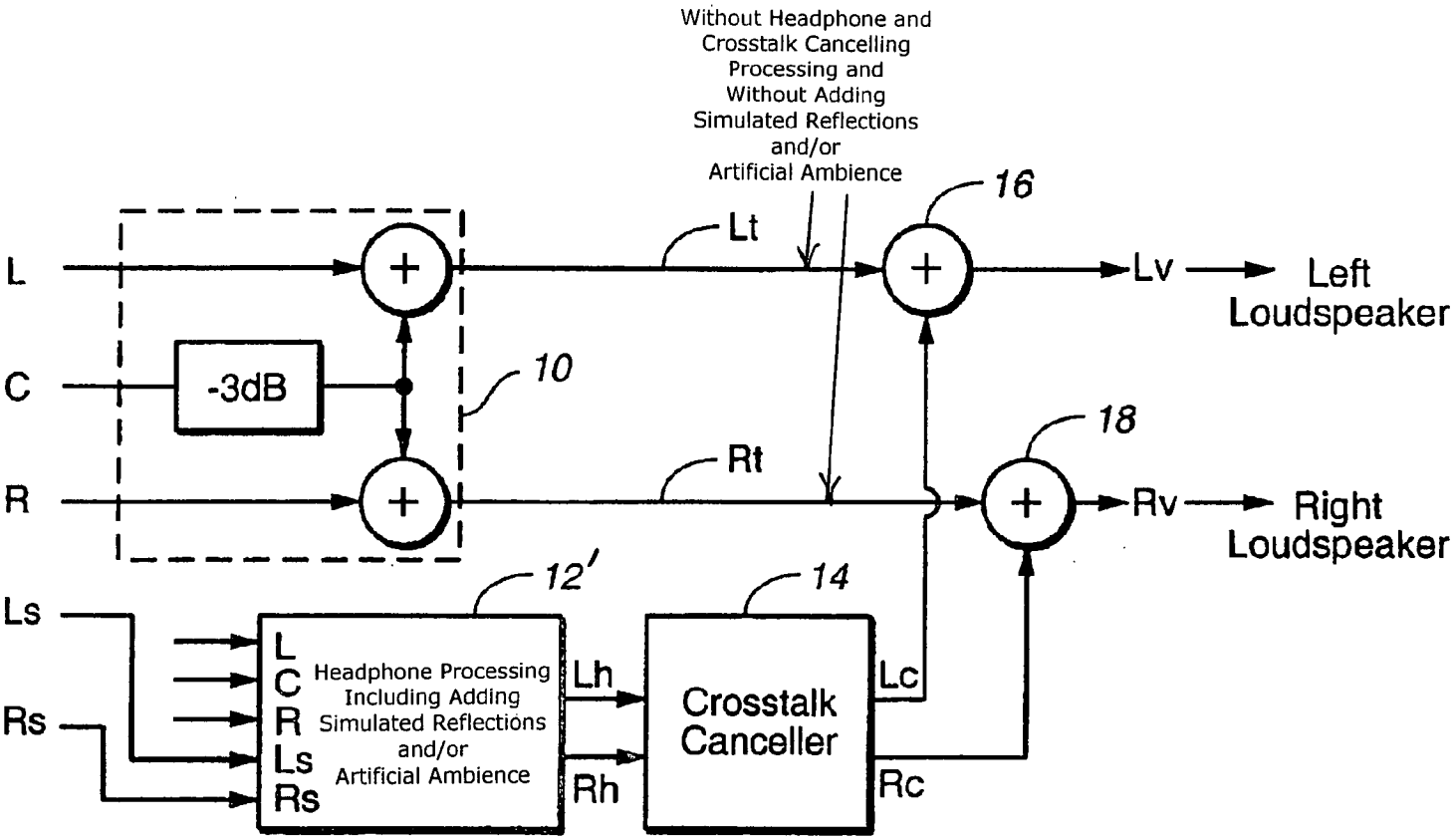
FIG. 3 is an idealized functional block diagram of an arrangement in accordance with the present invention in which the headphone processing applied to some audio channels includes adding simulated reflections and/or artificial ambience and other audio channels are without headphone and crosstalk cancelling processing and without adding simulated reflections and/or artificial ambience.

FIG. 3 is generally the same as FIG. 2 except that instead of a Headphone Processor 12, a block 12' applies headphone processing including adding simulated reflections and/or artificial ambience. Such processing is not applied to Lt and Rt, thus the figure shows that Lt and Rt are without headphone and crosstalk cancelling processing and without adding simulated reflections and/or artificial ambience.

It should be understood that implementation of other variations and modifications of the invention and its various aspects will be apparent to those skilled in the art, and that the invention is not limited by these specific embodiments described.

The present invention and its various aspects may be implemented in hardware, or as software functions performed in digital signal processors, programmed general-purpose digital computers, and/or special purpose digital computers, or as a combination of hardware and software functions. Interfaces between analog and digital signal streams may be performed in appropriate hardware and/or as functions in software and/or firmware.

The invention claimed is:

1. A method for improving the spatial perception of multiple sound channels when reproduced by two loudspeakers, each channel representing a direction, comprising applying some of said channels to said loudspeakers with headphone and crosstalk cancelling processing, wherein said headphone processing includes adding simulated reflections and/or artificial ambience to said some of said channels, and applying the other ones of said sound channels to said loudspeakers without headphone and crosstalk cancelling processing and without adding simulated reflections and/or artificial ambience to such other ones of said sound channels.

2. A method according to claim 1 wherein said two loudspeakers are generally front-located with respect to listeners and wherein sound channels representing directions other than front directions are applied to said loudspeakers with headphone and crosstalk cancelling processing and sound channels representing front directions are applied to loudspeakers without headphone and crosstalk cancelling processing.

3. A method according to claim 2 wherein said headphone processing further includes applying directional HRTFs to channels applied to said loudspeakers with headphone and crosstalk cancelling processing.

4. A method according to any one of claims 1-3 wherein applying sound channels to said loudspeakers without headphone and crosstalk cancelling processing includes encoding such sound channels to reduce the number of such sound channels to two when there are more than two of such sound channels.

5. A method according to claim 4 wherein said encoding comprises matrix encoding.

6. A method according to claim 5 wherein said matrix encoding is 3:2 matrix encoding.

7. Audio apparatus for improving the spatial perception of multiple sound channels when reproduced by two loudspeakers, each channel representing a direction, comprising a processor receiving some of said sound channels and delivering two output signals, said processor including a headphone processor employing directional HRTFs and a crosstalk canceller, wherein said headphone processor further includes a simulated reflections and/or artificial ambience processor, a first additive combiner receiving one of the outputs of said processor and receiving the channels other than the channels applied to said processor with relative proportions in accordance with their directions, wherein the channels other than the channels applied to said processor have no added simulated reflections and/or artificial ambience, and providing a signal for one of said loudspeakers, a second additive combiner receiving the other of the outputs of said processor and receiving the channels other than the channels applied to said processor with relative proportions in accordance with their directions, wherein the channels other than the channels applied to said processor have no added simulated reflections and/or artificial ambience, and providing a signal for the other of said loudspeakers.

8. The apparatus of claim 7 wherein said two loudspeakers are generally front-located with respect to listeners and wherein sound channels representing front directions are coupled to the first and second additive combiners and sound channels representing directions other than front directions are coupled to said headphone processor.

9. The apparatus according to claim 7 or claim 8 further comprising an N:2 matrix encoder, wherein ones of the multiple sound channels not coupled to the headphone processor are coupled to said additive combiners via the N:2 encoder.

10. The apparatus according to claim 7 wherein there are five sound channels, L, C, R, Ls, and Rs, said processor receiving said Ls and Rs signals, said L, C, and R channels applied to said first and second additive combiners with relative proportions such that all of the L channel and none of the R channel is received by one of the combiners, all of the R channel and none of the L channel is received by the other of the combiners, and a substantially equal proportion of the C channel is received by each of the combiners.

11. A method for improving the spatial perception of multiple sound channels when reproduced by two loudspeakers, each channel representing a direction, comprising applying some of said channels to said loudspeakers with headphone and crosstalk cancelling processing, wherein said headphone processing includes adding simulated reflections and/or artificial ambience to channels applied to said loudspeakers, and applying the other ones of said sound channels to said loudspeakers without headphone and crosstalk cancelling processing and without adding simulated reflections and artificial ambience to such other ones of said sound channels.

12. A method for improving the spatial perception of multiple sound channels when reproduced by two loudspeakers, each channel representing a direction, comprising applying some of said channels to said loudspeakers with headphone and crosstalk cancelling processing, wherein said headphone processing includes adding simulated reflections and artificial ambience to said some of said channels, and applying the other ones of said sound channels to said loudspeakers without headphone and crosstalk cancelling processing and without adding simulated reflections and artificial ambience to such other ones of said sound channels.

* * * * *